US007455547B2

(12) United States Patent
Hemmi et al.

(10) Patent No.: US 7,455,547 B2
(45) Date of Patent: Nov. 25, 2008

(54) CONNECTOR FOR PRINTED CIRCUIT BOARD AND FLEXIBLE PRINTED CIRCUIT BOARD

(75) Inventors: Yoshinobu Hemmi, Kawasaki (JP); Junichiro Kumagai, Okayama (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 11/860,916

(22) Filed: Sep. 25, 2007

(65) Prior Publication Data

US 2008/0081501 A1 Apr. 3, 2008

(30) Foreign Application Priority Data

Sep. 28, 2006 (JP) ..... 2006-265158

(51) Int. Cl.
*H01R 12/24* (2006.01)

(52) U.S. Cl. ..... 439/495; 439/260; 439/267

(58) Field of Classification Search ..... 439/260, 439/267, 495, 492, 493
See application file for complete search history.

(56) References Cited

U.S. PATENT DOCUMENTS 6,352,442 B1 * 3/2002 Kudo ..... 439/260

FOREIGN PATENT DOCUMENTS

JP 2005-56765 A 3/2005

OTHER PUBLICATIONS

English abstract of JP2005056765 published Mar. 3, 2005, esp@cenet database, 1 page.

* cited by examiner

*Primary Examiner*—Javaid Nasri
(74) *Attorney, Agent, or Firm*—Osha•Liang LLP

(57) ABSTRACT

A connector includes a base mounted with connecting terminals at a predetermined pitch and an operating lever turnably supported on the base. The operating lever presses and connects a tip end portion of a flexible printed circuit board against and to fixed contacts of the connecting terminals. Mounting protrusions provided to opposite end portions of the operating lever are moved along first slide faces, tapered faces, and second slide faces. The faces are formed in an uninterrupted manner on upper end faces of partition walls provided to opposite side end portions of the base. Turning shaft portions coaxially provided in an interrupted manner to remaining one side edge portion of the operating lever push up elastic finger portions of the connecting terminals. The turning shaft portions are turnably fitted in bearing recessed portions formed at the elastic finger portions.

4 Claims, 14 Drawing Sheets

(A)

(B)

(A)

(B)

(A)

(B)

(A)

(B)

(A)

(B)

(A)

(B)

(A)

(B)

CONNECTOR FOR PRINTED CIRCUIT BOARD AND FLEXIBLE PRINTED CIRCUIT BOARD

BACKGROUND OF THE INVENTION

1. Field of the Invention

The present invention relates to a connector and particularly to a connector which is surface-mounted on a printed circuit board and to which a flexible printed circuit board (hereinafter referred to as "FPC") is connected by a front locking method.

2. Description of the Related Art

Conventionally, there is a connector described in Japanese Patent Application Laid-Open No. 2005-56765, for example, in which a pressing cover 30 is turnably supported on a connector main body 10 and the pressing cover 30 is pulled down to thereby connect a flexible circuit 1 to terminals 20 of the connector.

In the above-described connector, however, a jig is necessary to mount the pressing cover 30 to the connector main body 10, mounting operation takes effort, and productivity is low in actuality.

SUMMARY OF THE INVENTION

With the above problems in view, it is an object of the present invention to provide a connector with which a jig is unnecessary in mounting operation, the mounting operation is easy, and productivity is high.

To achieve the above object, a connector according to the present invention includes a base mounted with connecting terminals at a predetermined pitch and an operating lever turnably supported on the base, the operating lever pressing and connecting a tip end portion of a flexible printed circuit board against and to fixed contacts of the connecting terminals, wherein mounting protrusions provided to opposite side end portions of the operating lever are moved along first slide faces, tapered faces, and second slide faces formed in an uninterrupted manner on upper end faces of partition walls provided to opposite side end portions of the base, turning shaft portions coaxially provided in an interrupted manner to remaining one side edge portion of the operating lever push up elastic finger portions of the connecting terminals, and the turning shaft portions are turnably fitted in bearing recessed portions formed at the elastic finger portions.

According to the present invention, by sliding the mounting protrusions of the operating lever along the first slide faces, the tapered faces, and the second slide faces provided to upper end portions of the partition walls of the base, the turning shaft portions of the operating lever can be turnably mounted in the bearing recessed portions of the connecting terminals without using a mounting jig. As a result, it is possible to obtain the connector with which mounting operation is easy and productivity is high.

In an embodiment of the present invention, pressing protrusions may be formed to protrude from inner side faces of elastic arm portions extending from outer side faces of the partition walls and pressure receiving tongue pieces extending from the opposite side end portions of the operating lever may be caused to run on the pressing protrusions and come into contact with and be retained by the outer side faces of the partition walls.

According to the present embodiment, it is possible to restrict natural turning of the operating lever. As a result, the operating lever is prevented from being naturally turned due to vibration or the like to naturally fall down, come off the base, or obstruct connecting operation of the FPC. Because it is possible to prevent the operating lever from naturally falling down, the operating lever need not be held with one hand in mounting of the FPC and the worker can effectively use both his/her hands to connect the FPC to thereby improve productivity.

In another embodiment of the present invention, fitting protrusions protruding from the opposite side end portions of the operating lever may be fitted in fitting recessed portions formed at upper end portions of the elastic arm portions.

According to the present embodiment, it is possible to restrict natural turning of the operating lever. As a result, the operating lever is prevented from being naturally turned due to vibration or the like to naturally fall down, come off the base, or obstruct connecting operation of the FPC. Because it is possible to prevent the operating lever from naturally falling down, the operating lever need not be held with one hand in mounting of the FPC and the worker can effectively use both his/her hands to connect the FPC to thereby improve productivity.

DETAILED DESCRIPTION OF THE PREFERRED EMBODIMENT

An embodiment according to the present invention will be described based on the accompanying drawings (FIGS. 1A to 14C).

Figure 1A:
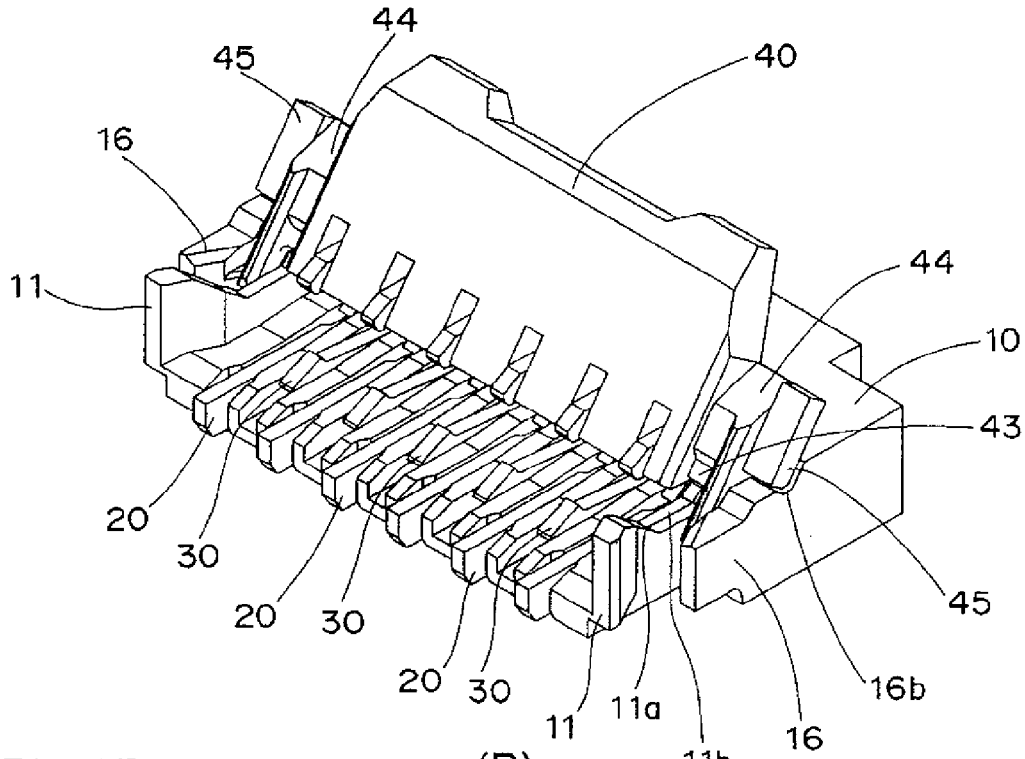
FIGS. 1A and 1B show perspective views of an embodiment of a connector according to the present invention before and after operation.
Figure 1B:
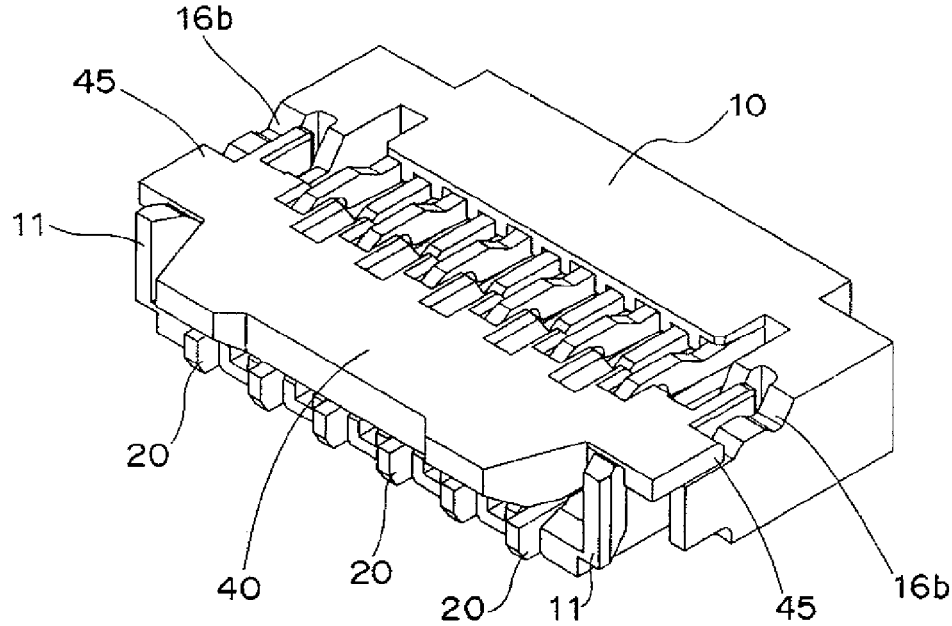
Figure 2:
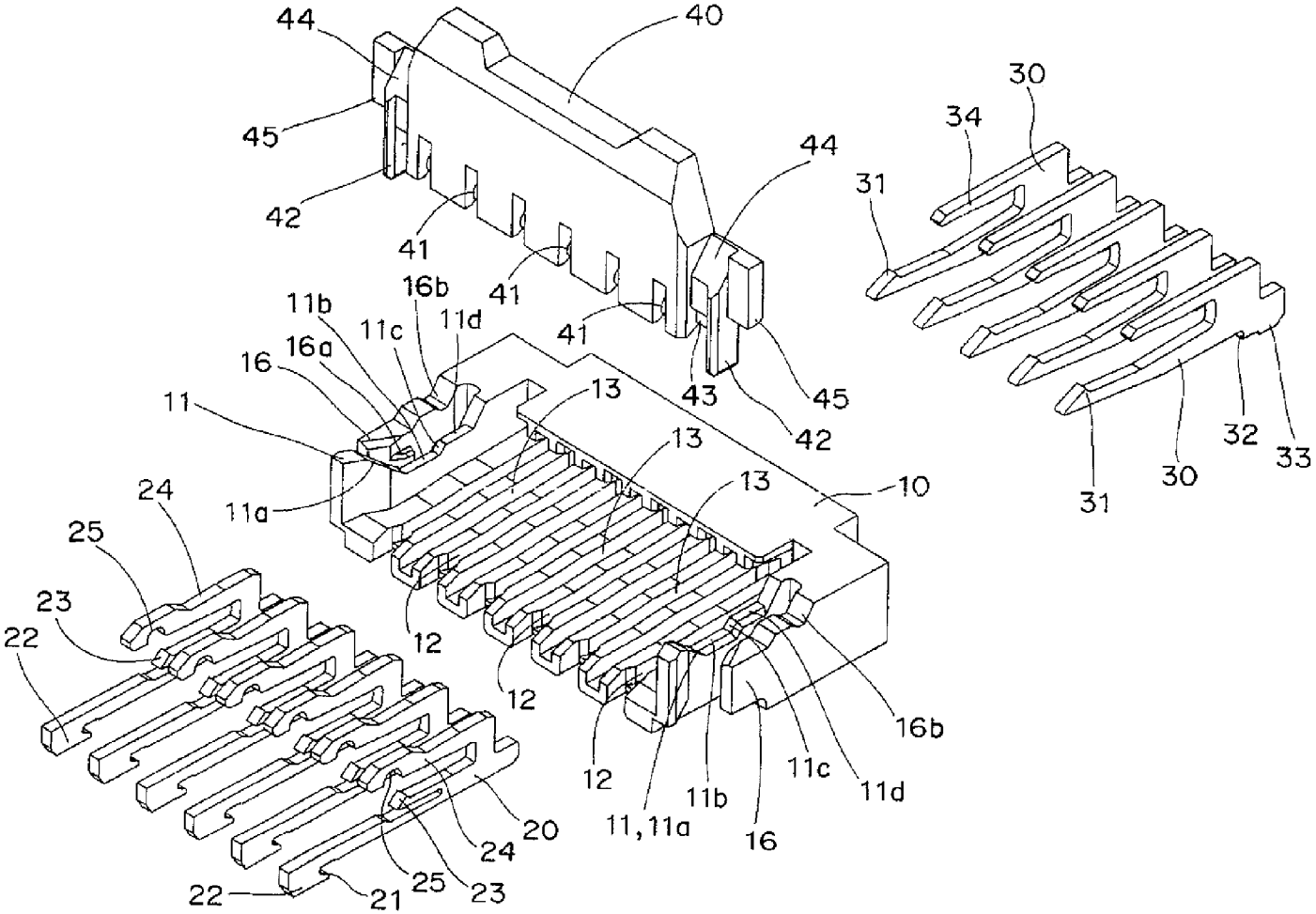
FIG. 2 shows an exploded perspective view of the connector shown in FIG. 1.

The connector according to the present embodiment is formed of a base 10, first connecting terminals 20, second connecting terminals 30, and an operating lever 40 as shown in FIGS. 1A to 2.

Dimensions of a connector embodying the present embodiment are 0.9 mm (height) by 3.5 mm (depth), and a pitch of adjacent connecting terminals is 0.3 mm.

Figure 3A:
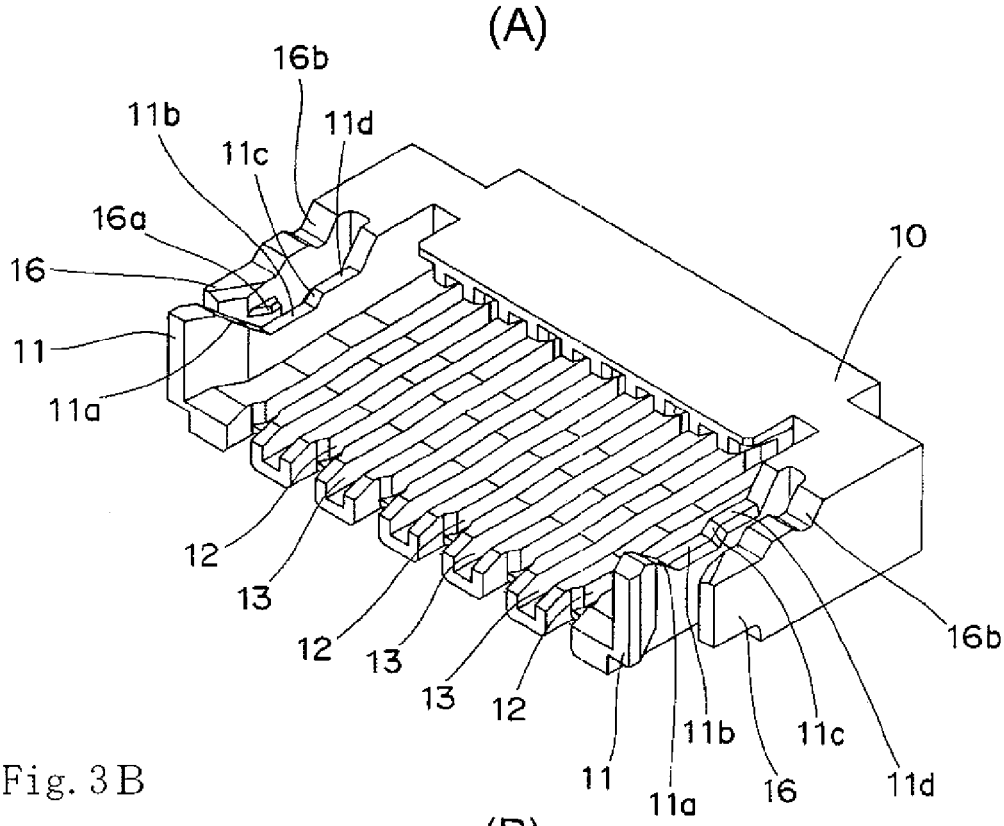
FIGS. 3A and 3B show perspective views of a base shown in FIG. 2 from different angles.
Figure 3B:
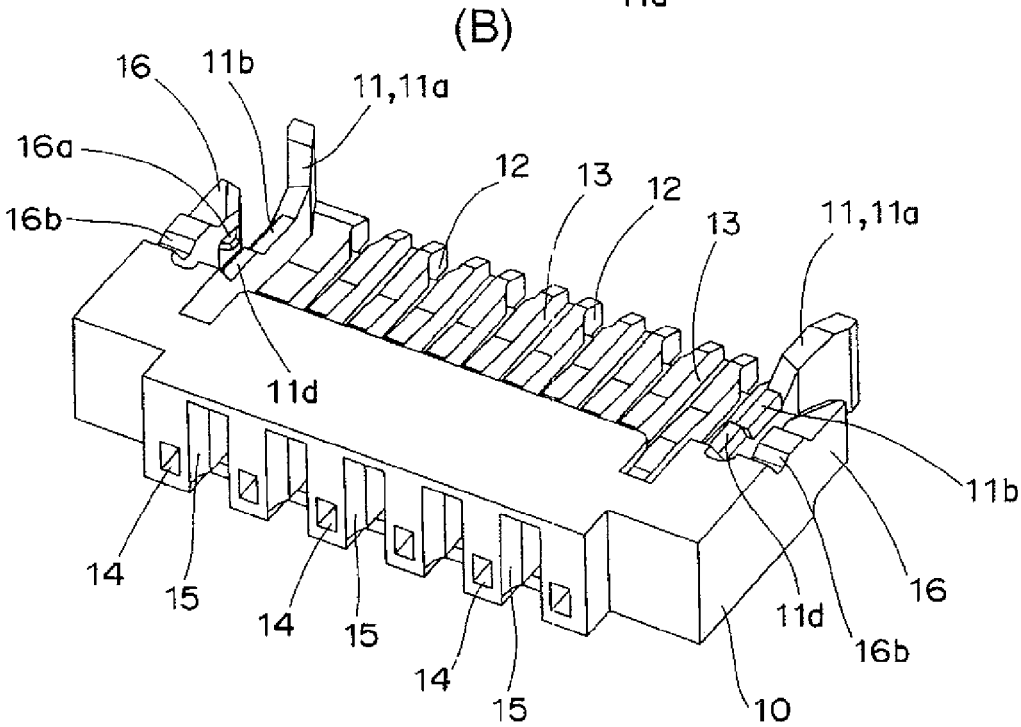
Figure 4:
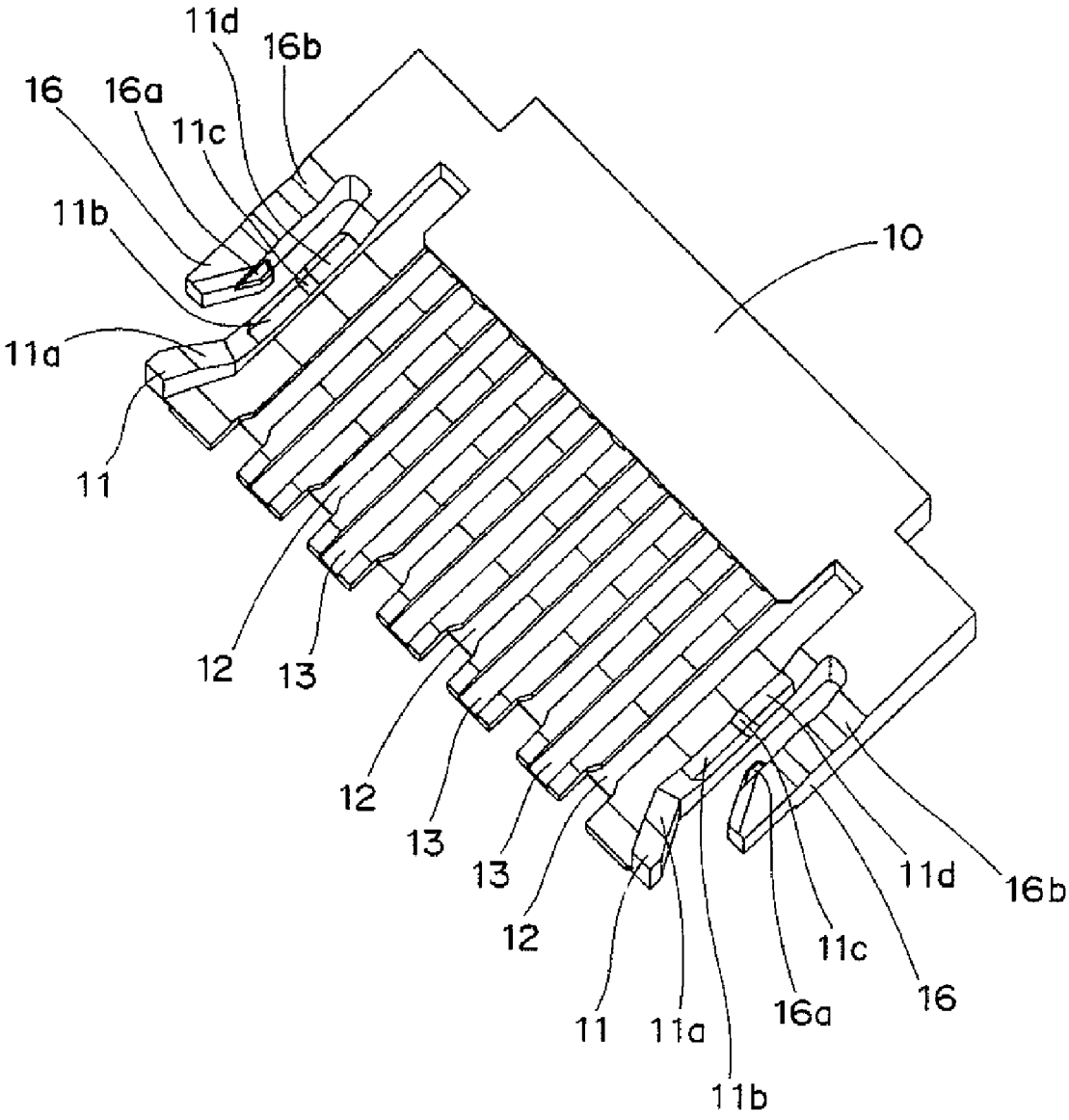
FIG. 4 shows a perspective view of the base shown in FIG. 2 from a different angle.

In the base 10, first and second guide grooves 12, 13 are alternately arranged at a predetermined pitch between partition walls 11, 11 provided to protrude from opposite side end portions to face each other as shown in FIGS. 3A to 4. Tip end edge portions of the partition walls 11 are slightly open outward so as to facilitate insertion of a flexible board 50 which will be described later. Moreover, each of the partition walls 11 has a first tapered face 11*a* for preventing coming off at its upper end face and is provided with a first slide face 11*b*, a second tapered face 11*c*, and a second slide face 11*d* in an uninterrupted manner so as to facilitate mounting operation of the operating lever 40 which will be described later. On the other hand, the first and second guide grooves 12, 13 respectively communicate with first and second terminal holes 14, 15 in which the first and second connecting terminals 20, 30 (to be described later) are to be press-fitted. From edge portions of the outer faces of the partition walls 11, respectively, elastic arm portions 16 extend in parallel. Each of the elastic arm portions 16 is provided at a tip end edge portion of its inner face with a pressing protrusion 16*a* and at a base portion of its upper end face with a fitting recessed portion 16*b*.

Figure 5A:
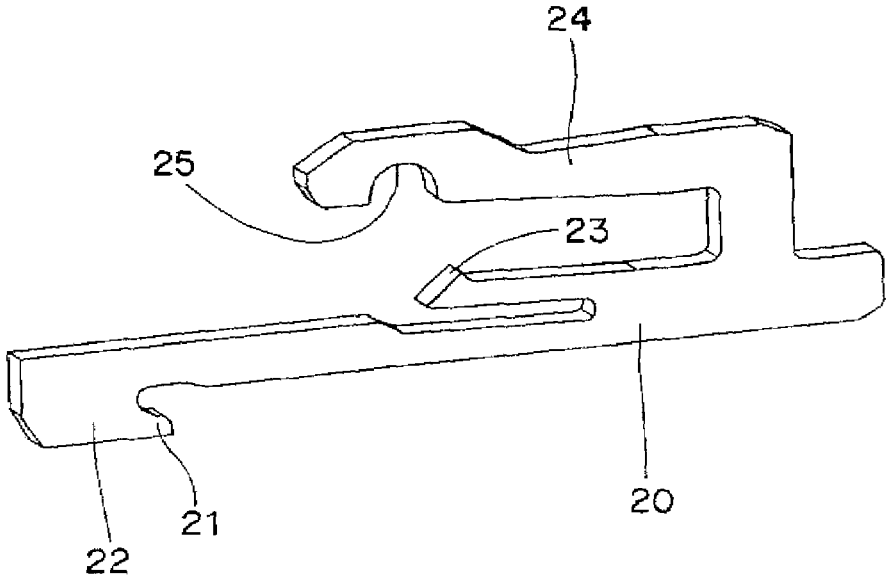
FIGS. 5A and 5B show perspective views of first and second connecting terminals shown in FIG. 2.

Each of the first connecting terminals 20 is formed of a conductive body having such a thickness that it can be inserted into the first guide groove 12 and is provided at its one end portion with a connecting portion 22 having a locking claw portion 21 as shown in FIG. 5A. From a central portion of the first connecting terminal 20, a first fixed contact 23 that can be elastically displaced is cut out. From a vicinity of the other end portion of the first connecting terminal 20, a substantially L-shaped elastic finger portion 24 extends. A bearing recessed portion 25 is formed at a tip end portion of a lower face of the elastic finger portion 24.

Figure 5B:
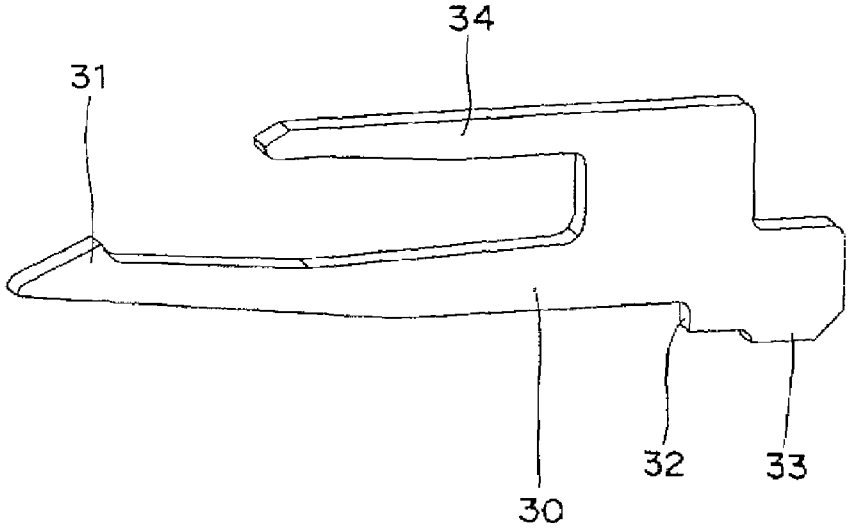
Figure 6A:
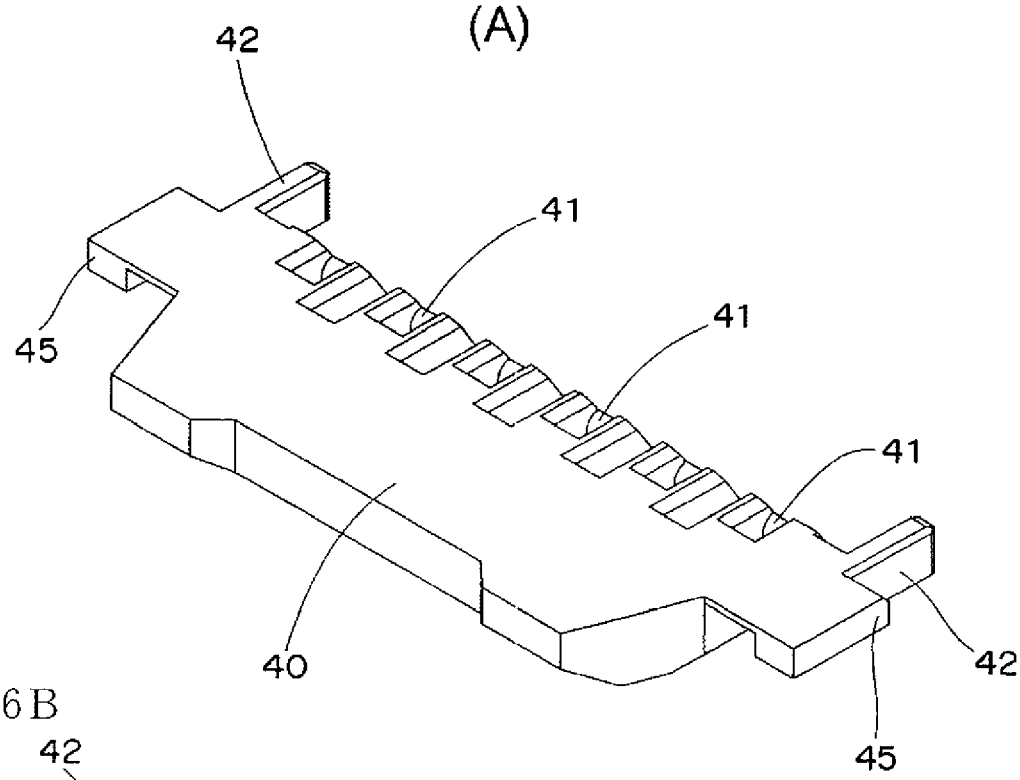
FIGS. 6A and 6B show perspective views of an operating lever shown in FIG. 2 from different angles.
Figure 6B:
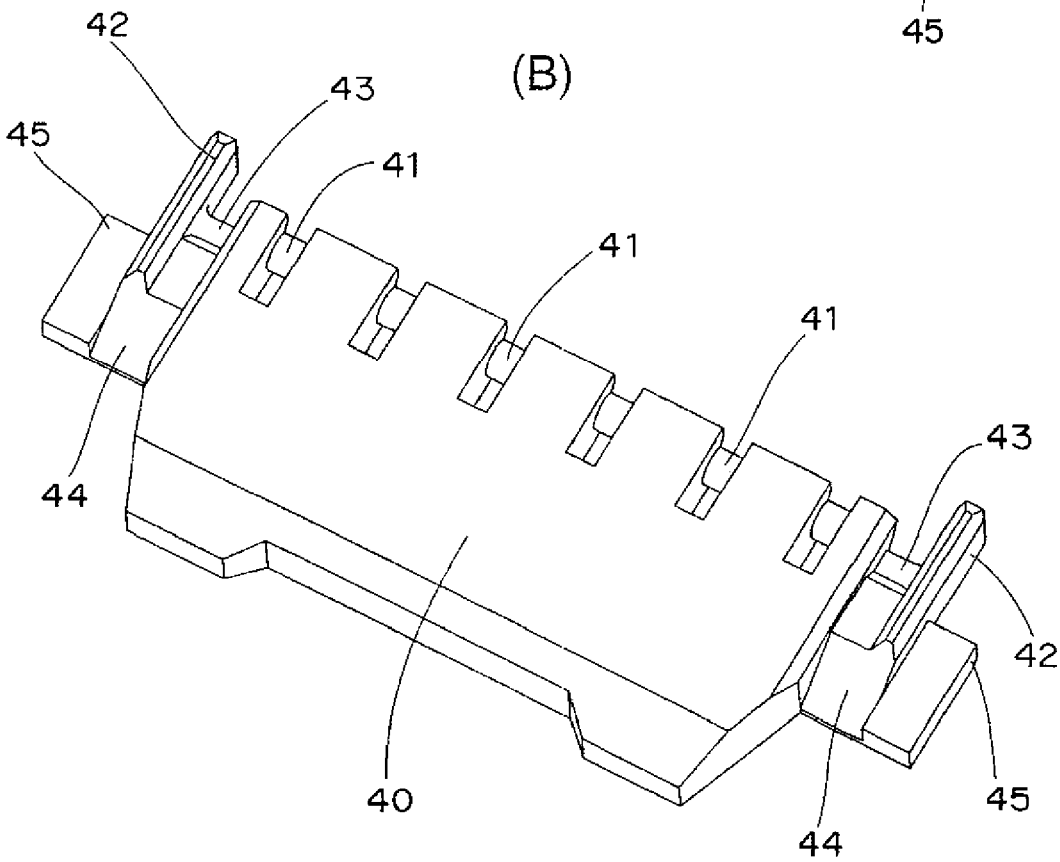
Figure 7A:
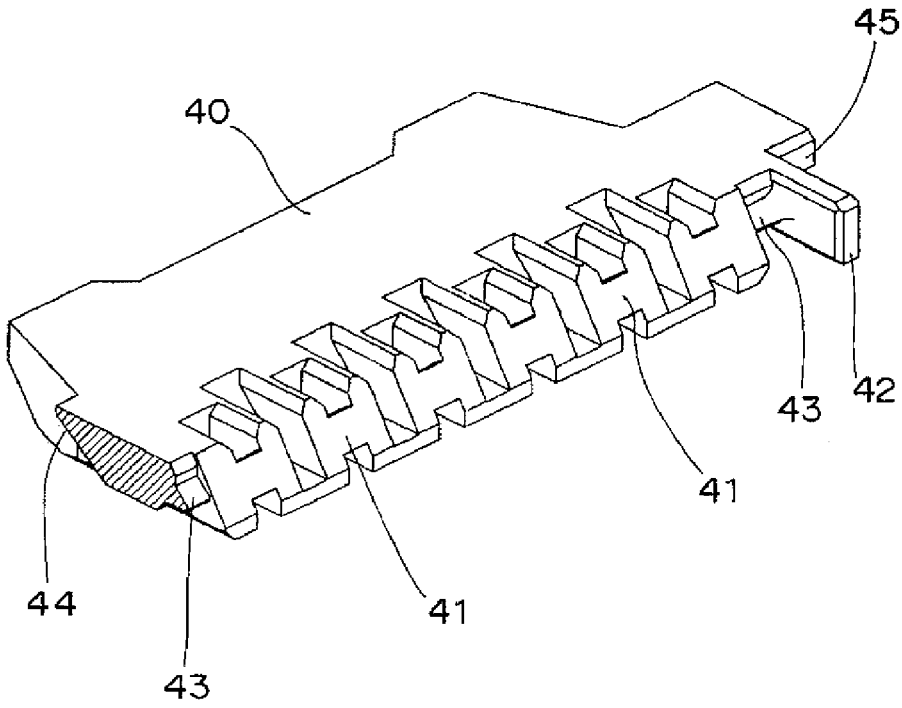
FIGS. 7A and 7B show partial cross-sectional perspective views of the operating lever shown in FIG. 6.
Figure 7B:
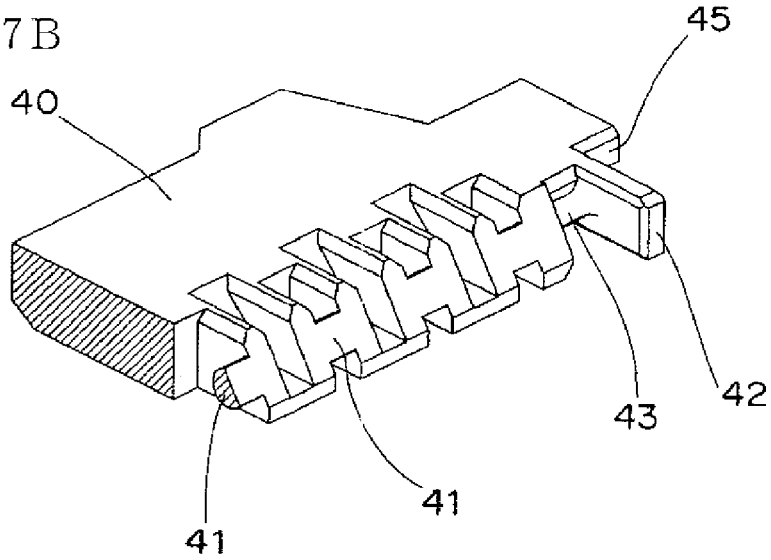
Figure 8A:
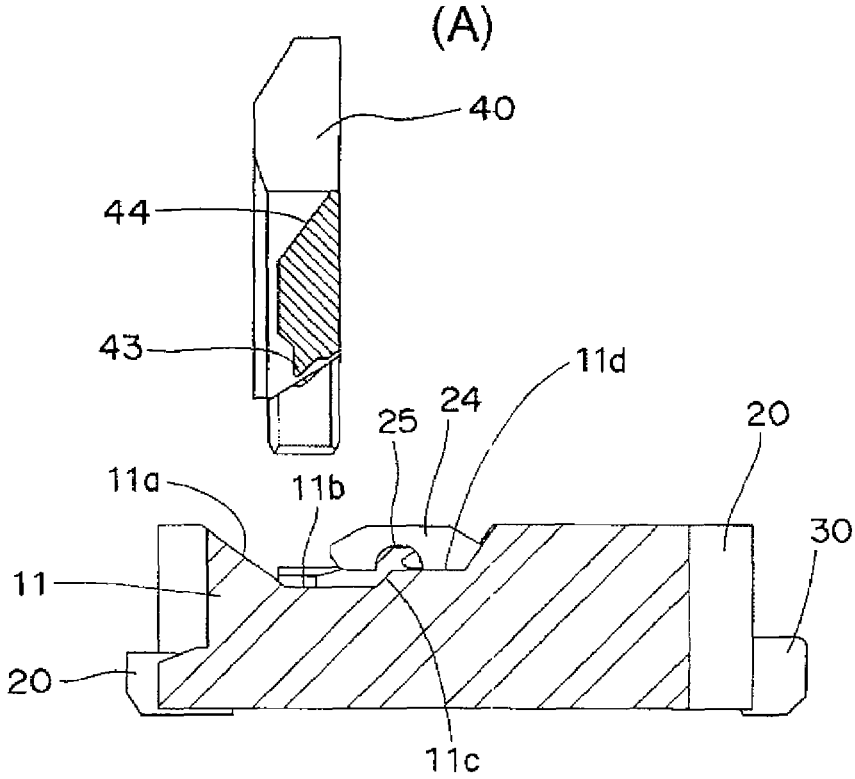
FIGS. 8A and 8B show cross-sectional views for explaining a method of mounting the operating lever to the base.
Figure 8B:
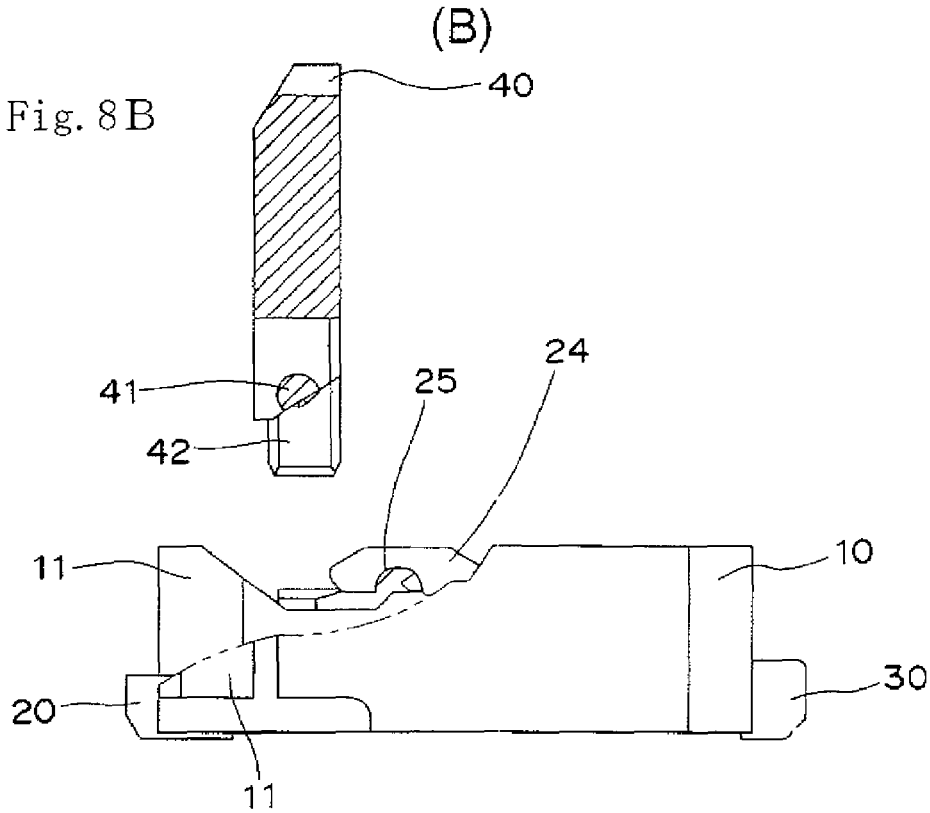
Figure 9A:
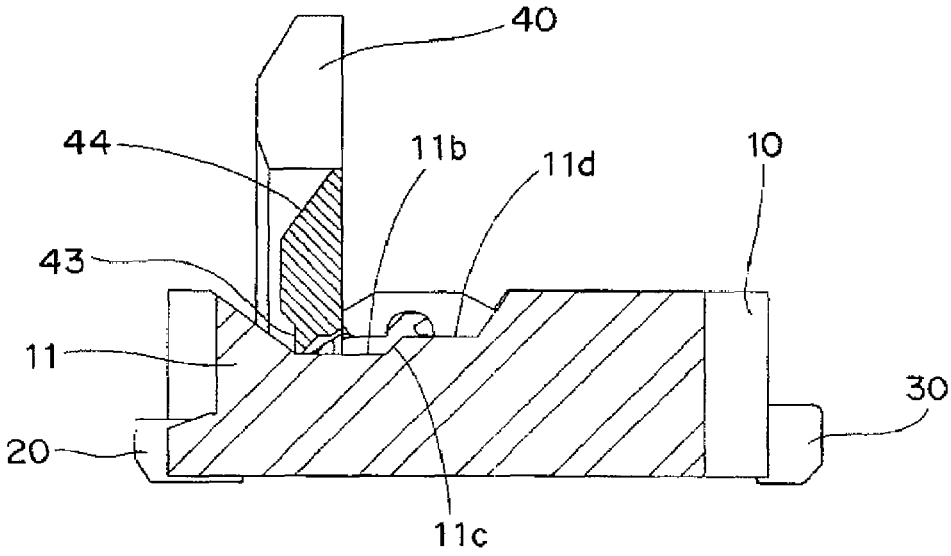
FIGS. 9A and 9B show cross-sectional views for explaining the method of mounting the operating lever to the base.
Figure 9B:
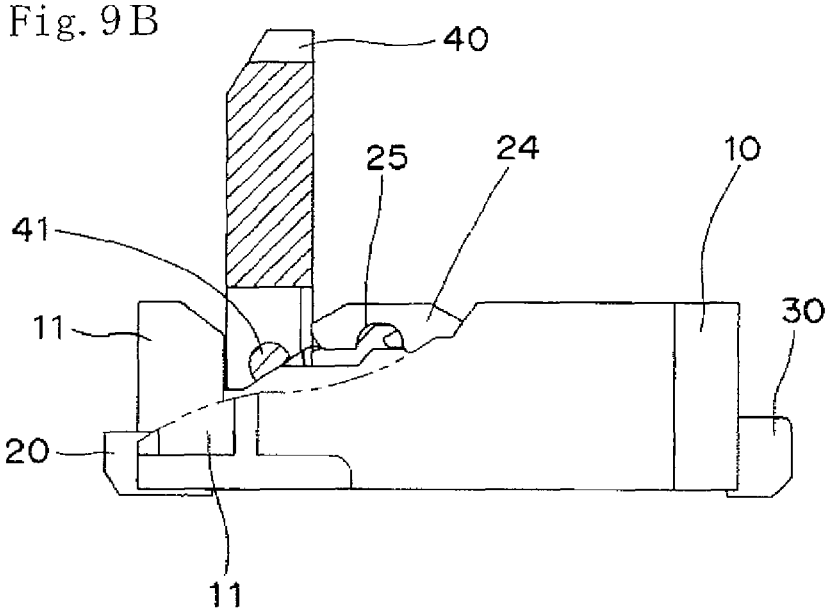

Each of the second connecting terminals 30 is formed of a conductive body having such a thickness that it can be inserted into the second guide groove 13 similarly to the first connecting terminal 20 and a second fixed contact 31 that can be elastically displaced is formed at one end portion of the second connecting terminal 30 as shown in FIG. 5B. The second connecting terminal 30 is provided at the other end portion with a connecting portion 33 having a positioning step portion 32. From a vicinity of the connecting portion 33, a substantially L-shaped press-fitting elastic finger portion 34 extends.

The operating lever 40 has turning shaft portions 41 coaxially formed in an interrupted manner at an edge portion on one side as shown in FIGS. 6A to 7B. A mounting protrusion 43 and a withdrawal preventing tapered face 44 are formed between the operating lever 40 and a pressure receiving tongue piece 42 extending from each of opposite side end portions of the operating lever 40. Moreover, a fitting protruding portion 45 is formed on an outer face of the pressure receiving tongue piece 42.

On a lower face of a tip end portion 51 of an FPC 50 (FIGS. 14A to 14C) connected in the embodiment, connecting pads (not shown) are arranged at a predetermined pitch.

Next, a method of mounting the above-described component parts will be described.

First, if each of the first connecting terminals 20 is slid along the first guide groove 12 of the base 10 to insert the first connecting terminal 20 into the first terminal hole 14, the locking claw portion 21 is locked to an edge portion of the base 10 and positioned. Then, by inserting each of the second connecting terminals 30 into the second terminal hole 15 of the base 10, the protruding second fixed contact 31 moves by sliding along the second guide groove 13 and the positioning step portion 32 comes in contact with the base 10 and is positioned. As a result, the first fixed contact 23 of the first connecting terminal 20 and the second fixed contact 31 of the second connecting terminal 30 are positioned at the front and back in a direction of insertion to form a staggered configuration.

Figure 10A:
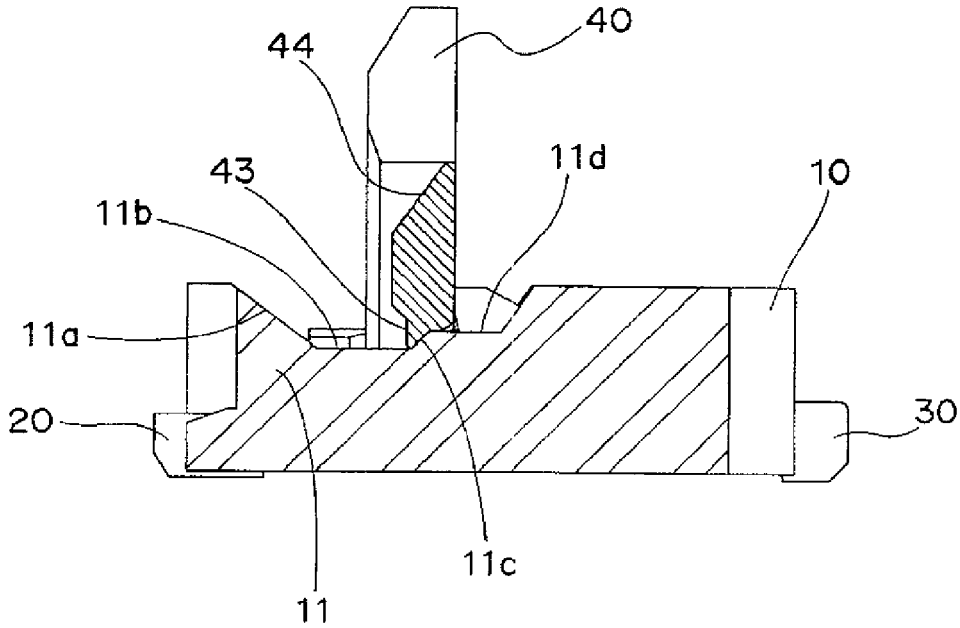
FIGS. 10A and 10B show cross-sectional views for explaining the method of mounting the operating lever to the base.
Figure 10B:
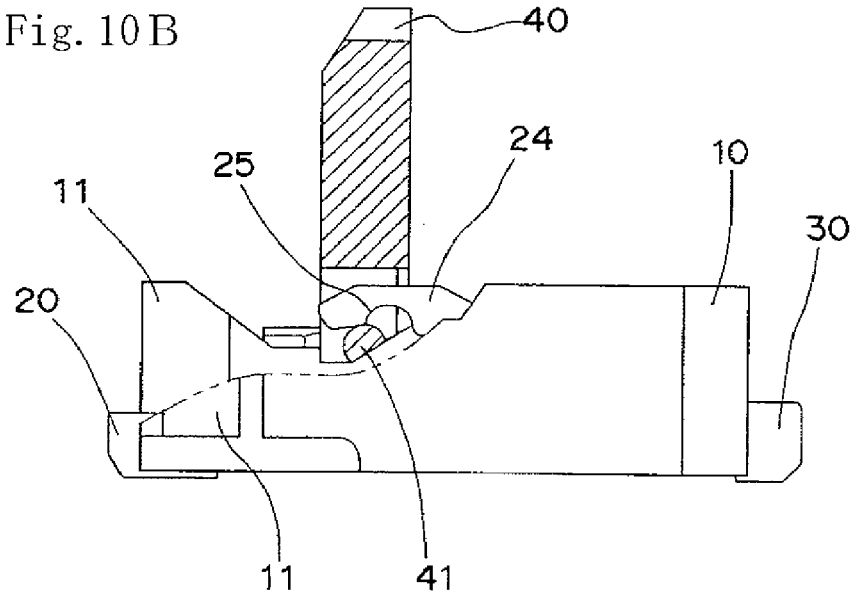
Figure 11A:
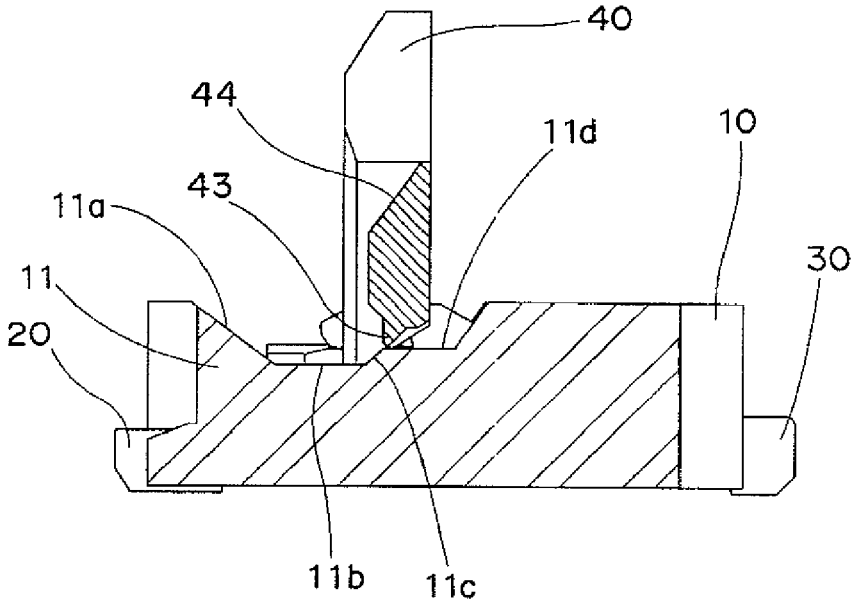
FIGS. 11A and 11B show cross-sectional views for explaining the method of mounting the operating lever to the base.
Figure 11B:
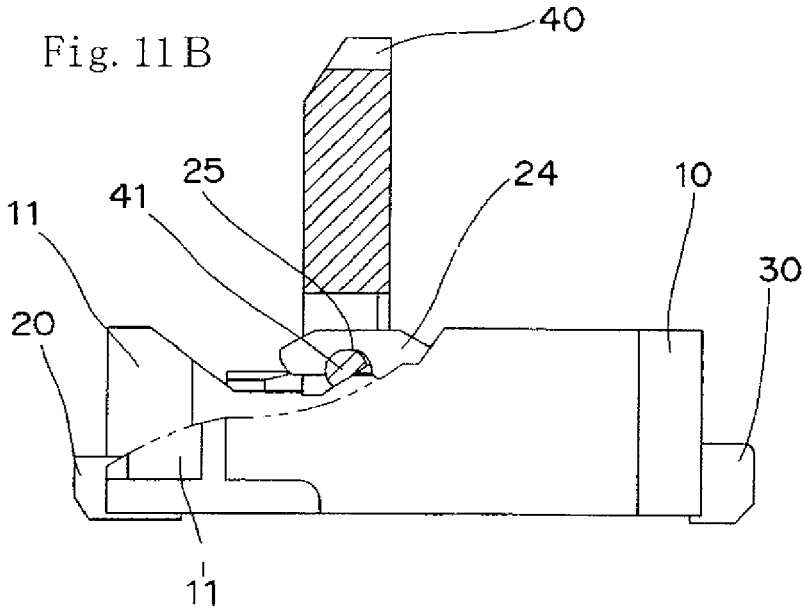

To mount the operating lever 40 to the base 10, the mounting protruding portions 43 of the vertically standing operating lever 40 are first positioned on the first slide faces 11*b* of the partition walls 11 as shown in FIGS. 8A to 9B. Furthermore, as shown in FIGS. 10A and 10B, the mounting protruding portions 43 are moved by sliding along the first slide faces 11*b* to the tapered faces 11*c* and, as a result, the turning shaft portions 41 push up the elastic finger portions 24 of the first connecting terminals 20. Then, as shown in FIGS. 11A and 11B, by sliding the mounting protruding portions 43 along the tapered faces 11*c* of the partition walls 11 and lifting them onto the second slide faces 11*d*, the turning shaft portions 41 are turnably fitted in the bearing recessed portions 25 of the first connecting terminals 20.

Figure 13A:
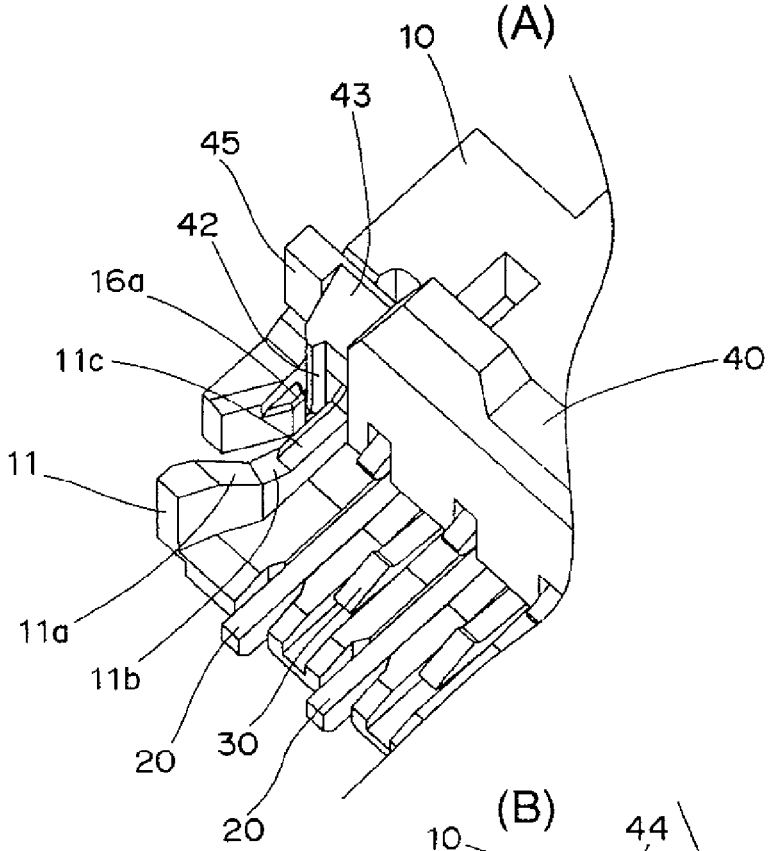
FIGS. 13A and 13B show partial enlarged perspective views for explaining a method of locking the operating lever to the base.
Figure 13B:
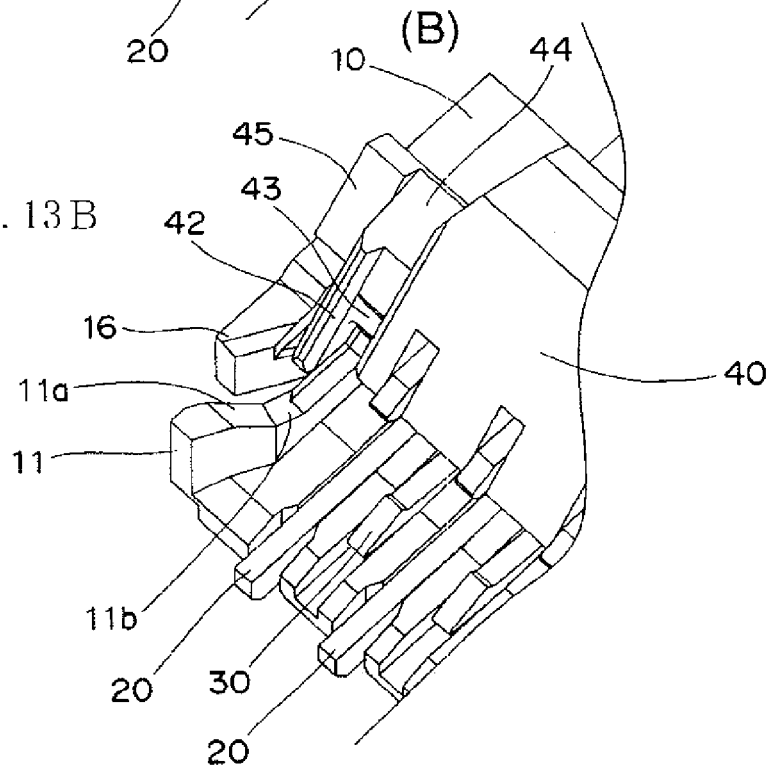

Furthermore, as shown in FIGS. 13A and 13B, by pushing down the operating lever 40, the pressure receiving tongue pieces 42 run on the pressing protrusions 16*a* of the base 10 while being elastically deformed and come in pressure contact with outer side faces of the partition walls 11 to thereby restrict the operating lever 40 in the position. Moreover, the fitting protruding portions 45 of the operating lever 40 are fitted in the fitting recessed portions 16*b* of the elastic arm portions 16 to thereby further reliably restrict the operating lever 40 in the position.

In the present embodiment, because the pressure receiving tongue pieces 42 and the fitting protruding portions 45 of the operating lever 40 are reliably restricted in the positions on the base 10, it is possible to reliably keep retaining the operating lever 40 in the open state. Consequently, the operating lever 40 does not fall in mounting of the FPC 50 and therefore the operating lever 40 need not be held with one hand. As a result, a worker can use both his/her hands to mount the FPC 50 to thereby facilitate mounting operation and improve workability.

Figure 14A:
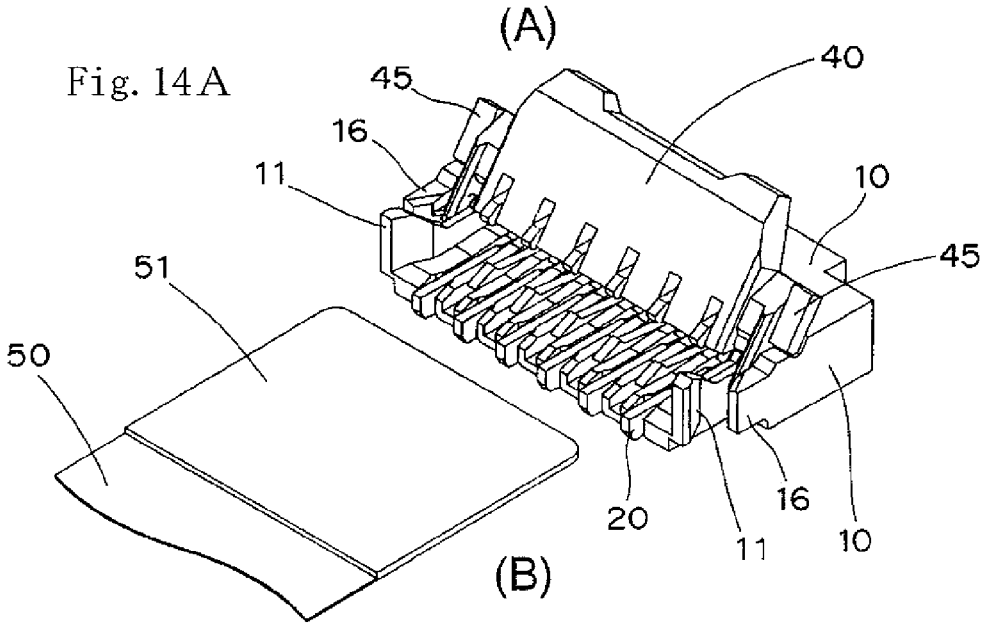
FIGS. 14A, 14B, and 14C show perspective views for explaining a method of connecting a flexible printed circuit board to the connector according to the present invention.
Figure 14B:
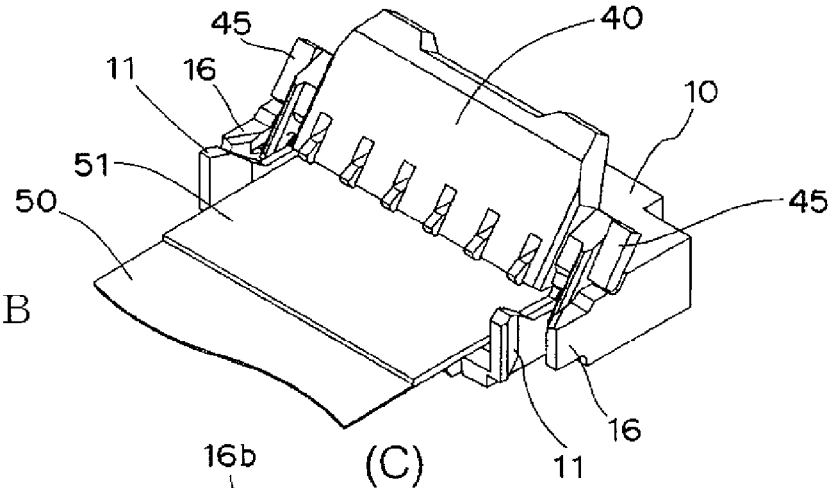
Figure 14C:
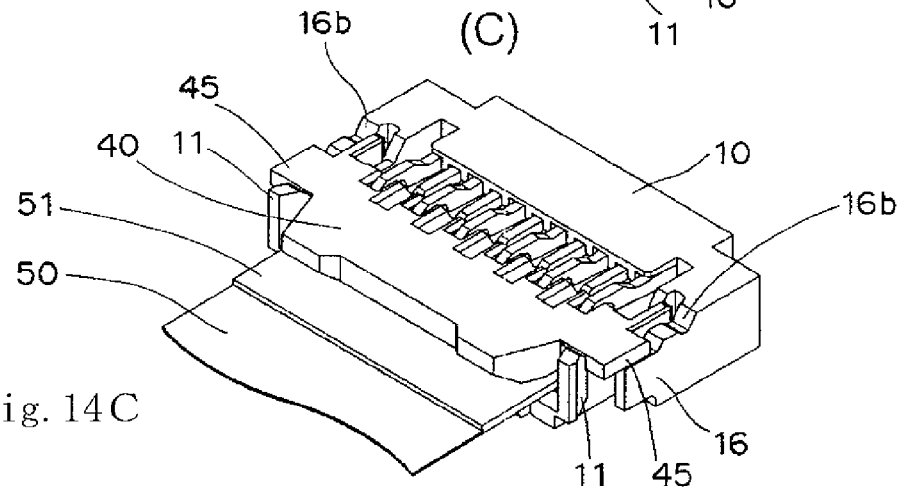

To mount the FPC 50 to the connector, as shown in FIGS. 14A to 14C, the FPC 50 is inserted between the partition walls 11 of the base 10 and pushed in until the tip end portion 51 of the FPC 50 comes in contact with an inner face of the base 10. Then, by pulling down the operating lever 40, the pressure receiving tongue pieces 42 are separated from the pressing protrusions 16*a* of the base 10. By further pushing down the operating lever 40, the elastic finger portions 24 of the first connecting terminals 20 push down the operating lever 40 through the turning shaft portions 41. As a result, the operating lever 40 pushes and connects the connecting pads provided to the lower face of the tip end portion 51 of the FPC 50 against and to the first and second fixed contacts 23, 31.

Figure 12A:
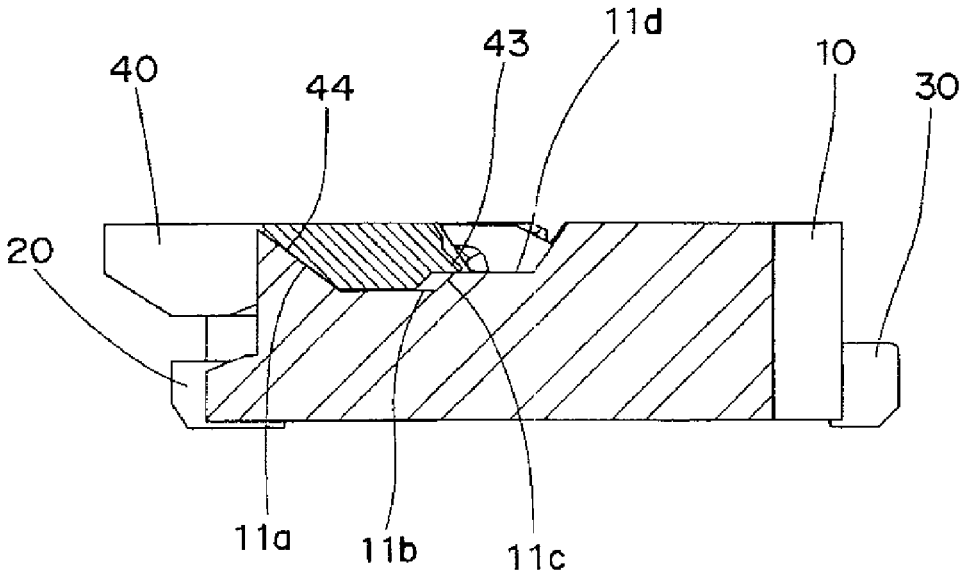
FIGS. 12A and 12B show cross-sectional views for explaining the method of mounting the operating lever to the base.
Figure 12B:
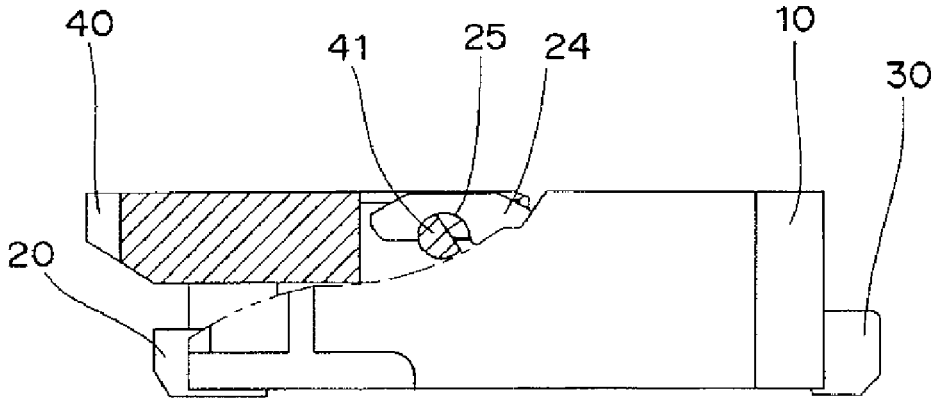

According to the present embodiment, as shown in FIGS. 12A and 12B, when the operating lever 40 is fully brought down to a horizontal position, the tapered faces 44 of the operating lever 40 come in contact with the first tapered faces

11*a* of the base 10 and the turning shaft portions 41 are fitted in the bearing recessed portions 25 of the first connecting terminals 20. Therefore, even when horizontal external force is applied to the operating lever 40, the operating lever 40 cannot be displaced or lifted to thereby prevent an accident of detachment of the FPC 50.

According to the present embodiment, biasing force of the first connecting terminals 20 applied to the operating lever 40 is designed to reach its maximum when the operating lever 40 is tilted slightly forward rather than when the operating lever 40 is supported vertically as shown in FIGS. 11A and 11B. Therefore, when the operating lever 40 is brought down to the horizontal position to connect and retain the FPC 50, the biasing force increases as the operating lever 40 is pulled up. As a result, even when external vibration is applied, it is possible to prevent an accident in which the operating lever 40 is pulled up and the FPC 50 is lifted.

To detach the FPC 50, the operating lever 40 is pulled up to thereby rotate it around axes of the turning shaft portions 41 as fulcrums. Furthermore, by pushing down the operating lever 40, the pressure receiving tongue pieces 42 run on the pressing protrusions 16*a* while being elastically deformed and come in contact with the outer side faces of the partition walls 11 and the fitting protruding portions 45 of the operating lever 40 are fitted in the fitting recessed portions 16*b* of the base 10 to thereby restrict the position.

Although the connector having lower contacts has been described in the above-described embodiment, the present invention may be applied to a connector having upper contacts or upper and lower contacts.

It is needless to say that the connector according to the present invention may be applied not only to the connector according to the above-described embodiment but also to other connectors.

What is claimed is:

1. A connector comprising:

a base mounted with connecting terminals at a predetermined pitch; and an operating lever turnably supported on the base, the operating lever pressing and connecting a tip end portion of a flexible printed circuit board against and to fixed contacts of the connecting terminals, wherein mounting protrusions provided to opposite side end portions of the operating lever are moved along first slide faces, tapered faces, and second slide faces formed in a continuous manner on upper end faces of partition walls provided to opposite side end portions of the base, turning shaft portions coaxially provided in a discontinuous manner to remaining one side edge portion of the operating lever push up elastic finger portions of the connecting terminals, and the turning shaft portions are turnably fitted in bearing recessed portions formed at the elastic finger portions.

2. A connector according to claim 1, wherein pressing protrusions are formed to protrude from inner side faces of elastic arm portions extending from outer side faces of the partition walls and pressure receiving tongue pieces extending from the opposite side end portions of the operating lever are caused to run on the pressing protrusions and come into contact with and be retained by the outer side faces of the partition walls.

3. A connector according to claim 1, wherein fitting protrusions protruding from the opposite side end portions of the operating lever are fitted in fitting recessed portions formed at upper end portions of the elastic arm portions.

4. A connector according to claim 2, wherein fitting protrusions protruding from the opposite side end portions of the operating lever are fitted in fitting recessed portions formed at upper end portions of the elastic arm portions.

* * * * *